US009979070B2

(12) United States Patent
Liang et al.

(10) Patent No.: US 9,979,070 B2
(45) Date of Patent: May 22, 2018

(54) RESONATOR, FILTER, DUPLEXER, MULTIPLEXER, AND COMMUNICATIONS DEVICE

(71) Applicant: Huawei Technologies Co., Ltd., Shenzhen (CN)

(72) Inventors: Dan Liang, Kista (SE); Ke Chen, Shenzhen (CN); Xiaoyi Deng, Chengdu (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 9 days.

(21) Appl. No.: 15/199,163

(22) Filed: Jun. 30, 2016

(65) Prior Publication Data

US 2016/0315368 A1 Oct. 27, 2016

Related U.S. Application Data

(63) Continuation of application No. PCT/CN2013/090904, filed on Dec. 30, 2013.

(51) Int. Cl.
*H01P 7/04* (2006.01)
*H01P 1/213* (2006.01)
(Continued)

(52) U.S. Cl.
CPC ..... *H01P 7/04* (2013.01); *H01P 1/205* (2013.01); *H01P 1/207* (2013.01); *H01P 1/2133* (2013.01); *H01P 7/06* (2013.01)

(58) Field of Classification Search
CPC ..... H01P 1/205; H01P 1/2053; H01P 7/04; H01P 7/06; H01P 7/10; H01P 1/2133
(Continued)

(56) References Cited

U.S. PATENT DOCUMENTS 5,541,560 A * 7/1996 Turunen ..... H01P 1/2056 333/134
8,947,178 B1 * 2/2015 Reid, Jr. ..... H01P 1/2053 333/207
(Continued)

FOREIGN PATENT DOCUMENTS

CN 101546857 A 9/2009
CN 201629390 U 11/2010
(Continued)

OTHER PUBLICATIONS

Partial English Translation and Abstract of Chinese Patent Application No. CN102637940, Oct. 24, 2016, 9 pages.
(Continued)

*Primary Examiner* — Rakesh Patel
(74) *Attorney, Agent, or Firm* — Conley Rose, P.C.

(57) ABSTRACT

A resonator, a filter, a duplexer, a multiplexer, and a communications device that use the resonator, where the resonator includes a resonant cavity body that has a resonant cavity and an open end, a cover that covers the open end and that is connected to the resonant cavity body, and a resonant tube that is located inside the resonant cavity, a medium material is padded in a capacitor area in the resonant cavity and whose dielectric constant is greater than 1, the resonant tube includes a resonant tube body and an elastic structure that is combined with the resonant tube body, and the elastic structure provides elastic pressure in an axial direction of the resonant tube where the resonator may reduce a conductor loss and improve a power capacity, and has relatively low costs.

22 Claims, 5 Drawing Sheets

(51) Int. Cl.
*H01P 1/207* (2006.01)
*H01P 1/205* (2006.01)
*H01P 7/06* (2006.01)

(58) Field of Classification Search
USPC ..... 333/134, 206, 207, 223, 231
See application file for complete search history.

(56) References Cited

U.S. PATENT DOCUMENTS

| | | | | |
|---|---|---|---|---|
| 2008/0258847 | A1* | 10/2008 | Snyder | H01P 1/202 333/207 |
| 2010/0308937 | A1 | 12/2010 | Myllyvainio et al. | |
| 2013/0002371 | A1* | 1/2013 | Ono | H01P 1/2135 333/126 |
| 2016/0233567 | A1 | 8/2016 | Tong et al. | |

FOREIGN PATENT DOCUMENTS

| | | | |
|---|---|---|---|
| CN | 202004138 | U | 10/2011 |
| CN | 202217778 | U | 5/2012 |
| CN | 102509819 | A | 6/2012 |
| CN | 202308237 | U | 7/2012 |
| CN | 102637940 | A | 8/2012 |
| CN | 103022621 | A | 4/2013 |
| CN | 103107389 | A | 5/2013 |
| EP | 0069785 | A1 | 1/1982 |
| EP | 1791212 | A1 | 5/2007 |
| JP | H06164221 | A | 6/1994 |
| JP | 20050223665 | A | 8/2005 |
| JP | 5399849 | B2 | 1/2014 |

OTHER PUBLICATIONS

Partial English Translation and Abstract of Chinese Patent Application No. CN103022621, Oct. 24, 2016, 13 pages.

Partial English Translation and Abstract of Chinese Patent Application No. CN101546857, Jul. 12, 2016, 4 pages.

Partial English Translation and Abstract of Japanese Patent Application No. JPS5399849, Jan. 29, 2014, 4 pages.

Foreign Communication From a Counterpart Application, European Application No. 13900752.0, Extended European Search Report dated Dec. 1, 2016, 6 pages.

Foreign Communication From a Counterpart Application, Chinese Application No. 201380009626.2, Chinese Office Action dated Sep. 21, 2016, 6 pages.

Foreign Communication From a Counterpart Application, Chinese Application No. 201380009626.2, Chinese Search Report dated Sep. 12, 2016, 2 pages.

Foreign Communication From a Counterpart Application, PCT Application No. PCT/CN2013/090904, English Translation of International Search Report dated Sep. 19, 2014, 2 pages.

Foreign Communication From a Counterpart Application, PCT Application No. PCT/CN2013/090904, English Translation of Written Opinion dated Sep. 19, 2014, 12 pages.

* cited by examiner

RESONATOR, FILTER, DUPLEXER, MULTIPLEXER, AND COMMUNICATIONS DEVICE

CROSS-REFERENCE TO RELATED APPLICATIONS

This application is a continuation of International Application No. PCT/CN2013/090904, filed on Dec. 30, 2013, which is hereby incorporated by reference in its entirety.

TECHNICAL FIELD

Embodiments of the present disclosure relates to the field of communications devices, and in particular, to a resonator, a filter, a duplexer, a multiplexer, and a communications device.

BACKGROUND

A development trend of wireless communications towards broader bands requires that a duplexer at a radio frequency front end of a base station have a smaller volume, a larger power capacity, and lower costs, and be also capable of maintaining performance such as a loss. A cavity (that is, a coaxial resonant cavity filled with air) filter is a traditional technology of a base station duplexer, and the technology is mature and cost effective. The cavity filter generally includes a cover and multiple cavities, and multiple resonant tubes are disposed in each cavity. Each cavity functions as an electronic oscillator circuit, and when the filter is tuned to a proper wavelength of a received signal, the oscillation circuit may be represented as a parallel oscillation circuit that includes an inductance part and a capacitance part, and a resonant frequency of the filter may be adjusted by adjusting the inductance part or the capacitance part.

A method for adjusting a capacitance is to adjust a distance between a resonant tube and a cover, where the distance is generally adjusted by screwing a tuning screw in or screwing a tuning screw out of a screw hole on the cover. As a volume of a single cavity continuously decreases, a current density on a surface of the single cavity increases and a loss continuously increases. The decrease in the volume also reduces a distance between surfaces of conductors in the single cavity. As a result, electric field strength increases and finally exceeds an air breakdown threshold, thereby reducing a power capacity. Therefore, a smaller volume of the cavity filter leads to a larger loss and a smaller power capacity, which cannot meet a requirement of maintaining unchanged performance with a smaller volume.

The cavity filter generally uses a metal resonator, that is, the cavity, the resonant tube, and the like are all made up of a metal material or a material that is metallic at least on an inner surface. In a case in which a volume of a single cavity of a transverse magnetic (TM) mode dielectric filter is the same as a volume of a single cavity of the cavity filter, the TM mode dielectric filter uses high-performance ceramic resonator instead of a metal resonator. When a reduced conductor loss of the TM mode dielectric filter is greater than a dielectric loss brought by the TM mode dielectric filter, a smaller insertion loss can be achieved. In addition, because parts that have the highest electric field strength in the TM mode dielectric filter are centralized inside the medium, and breakdown field strength of a medium material is far higher than that of air, the power capacity can also be greatly improved. However, a high-performance ceramic material generally includes rare earth, and due to global scarcity of rare earth resources, a price of the high-performance ceramic material is high.

SUMMARY

The present disclosure provides a resonator that can reduce a conductor loss and that has relatively low costs, and a filter, a duplexer, a multiplexer, and a communications device that use the resonator.

According to a first aspect, a resonator is provided, including a resonant cavity body, where the resonant cavity body has a resonant cavity and an open end, and the resonator further includes a cover that covers the open end and that is connected to the resonant cavity body, and a resonant tube that is located inside the resonant cavity, where the resonator further includes a medium material that is padded in the resonant cavity and whose dielectric constant is greater than 1, the resonant tube includes a resonant tube body and an elastic structure that is combined with the resonant tube body, the medium material is padded in a capacitor area in the resonant cavity, and the capacitor area includes an area between the resonant tube and the cover. Where the elastic structure is used to provide elastic pressure in an axial direction of the resonant tube such that an upper end face of the medium material is in close contact with a lower surface of the cover and a lower end face of the medium material is in close contact with an upper surface of the resonant tube.

In a first possible implementation manner of the first aspect, the resonator further includes a tuning screw, and the tuning screw is connected to the cover and is stuck into space surrounded by the resonant tube.

In a second possible implementation manner of the first aspect, the capacitor area further includes at least one of an area between the tuning screw and an inside wall of the resonant tube, and an area between an outer edge of the resonant tube and a cavity wall of the resonant cavity.

In a third possible implementation manner of the first aspect, the elastic structure is fastened to the resonant tube body by means of welding or is integrated with the resonant tube.

In a fourth possible implementation manner of the first aspect, the elastic structure is disposed on the top of the resonant tube, in the middle of the resonant tube, or at the bottom of the resonant tube.

In a fifth possible implementation manner of the first aspect, a notch is disposed on the elastic structure to increase elasticity.

In a sixth possible implementation manner of the first aspect, the elastic structure is a metal plate.

In a seventh possible implementation manner of the first aspect, a quality factor (Qf) of the medium material is greater than 1000.

In an eighth possible implementation manner of the first aspect, the padded medium material is separately crimped over the cover and the resonant tube.

In a ninth possible implementation manner of the first aspect, one surface of the medium material is bonded with or welded to one of the cover and the resonant tube, and another opposite surface is in close contact with the other one of the cover and the resonant tube using the elastic pressure provided by the elastic structure.

In a tenth possible implementation manner of the first aspect, the medium material includes ceramics, a single-crystal quartz, or alumina.

According to a second aspect, a filter is provided, including at least one resonator provided in the foregoing first aspect.

According to a third aspect, a duplexer is provided, including a transmit channel filter and a receive channel filter, where the transmit channel filter and the receive channel filter use the filter provided in the foregoing second aspect to perform filtering.

According to a fourth aspect, a multiplexer is provided, including multiple transmit channel filters and multiple receive channel filters, where the transmit channel filters and the receive channel filters use the filter provided in the foregoing second aspect to perform filtering.

According to a fifth aspect, a communications device is provided, including at least one resonator provided in the foregoing first aspect.

According to the resonator provided in implementation manners of the first aspect, a medium material is padded whose dielectric constant is greater than a dielectric constant of air such that a volume of the resonator can be reduced and a power capacity of the resonator can be improved, and because a volume of the padded medium material is relatively small, relative costs are relatively low. In addition, an elastic structure is disposed on a resonant tube, and the elastic structure is used to provide elastic pressure in an axial direction of the resonant tube such that an upper end face of the medium material is in close contact with a lower surface of the cover and a lower end face of the medium material is in close contact with an upper surface of the resonant tube, thereby ensuring that the medium material is in close contact with both the cover and the resonant tube. This effectively resolves a problem caused by a structure manufacturing error and an assembly tolerance such that various medium materials can be in close contact with a cover and a resonant tube, thereby strengthening an effect of improvement of a power capacity of a resonator and a decrease in a volume of the resonator.

BRIEF DESCRIPTION OF DRAWINGS

To describe the technical solutions in the embodiments of the present disclosure more clearly, the following briefly introduces the accompanying drawings required for describing the embodiments. The accompanying drawings in the following description show merely some embodiments of the present disclosure, and a person of ordinary skill in the art may still derive other drawings from these accompanying drawings without creative efforts.

DESCRIPTION OF EMBODIMENTS

The following clearly describes the technical solutions in the embodiments of the present disclosure with reference to the accompanying drawings in the embodiments of the present disclosure. The described embodiments are merely some but not all of the embodiments of the present disclosure. All other embodiments obtained by a person of ordinary skill in the art based on the embodiments of the present disclosure without creative efforts shall fall within the protection scope of the present disclosure.

Figure 1:
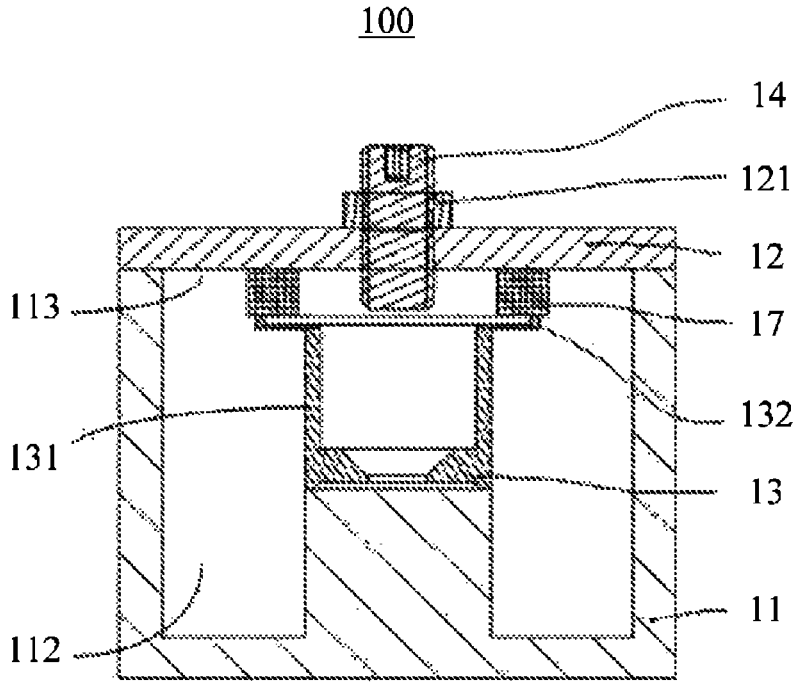
FIG. 1 is a cutaway diagram of a resonator according to a first implementation manner of the present disclosure.

Referring to FIG. 1, FIG. 1 is a cutaway diagram of a resonator 100 according to a first implementation manner of the present disclosure. The resonator 100 includes a resonant cavity body 11, a cover 12, and a resonant tube 13. The resonator 100 may further include a tuning screw 14.

The resonant cavity body 11 is a metal cavity body. The whole resonant cavity body 11 may be metal material or the resonant cavity body 11 is a cavity body that is metallic at least on an inner surface. The resonant cavity body 11 has a resonant cavity 112 and an open end 113. The cover 12 covers the open end 113 and is connected to the resonant cavity body 11, and the cover 12 and the resonant cavity body 11 may be connected using a screw and the like. The cover 12 may be an independent component, or may be a printed circuit board (PCB). When the PCB is securely installed on the resonant cavity body 11 and covers the open end 113, the PCB is used as the cover 12.

The resonant tube 13 is located inside the resonant cavity 112. In this implementation manner, the resonant tube 13 may be integrated with the resonant cavity body 11, that is, the resonant tube 13 is integrated on an inner side of the bottom of the resonant cavity body 11. In another implementation manner, the resonant tube 13 may also be an independently disposed component, and is securely connected to the resonant cavity body 11 using a fastening element.

The tuning screw 14 is connected to the cover 12 and is stuck into the resonant tube 13, and frequency adjustment may be performed by changing, by screwing the tuning screw 14, a length of a part that is of the tuning screw 14 and that is stuck into the resonant tube 13. In this implementation manner, the tuning screw 14 and the resonant tube 13 are coaxially disposed. A locking nut 121 is securely disposed on the cover 12, and the tuning screw 14 is threaded to the locking nut 121.

The resonator 100 further includes a medium material 17 that is padded in the resonant cavity 112 and whose dielectric constant is greater than 1. The medium material 17 is padded in a capacitor area of the resonant cavity 112.

The capacitor area may include an area between the resonant tube 13 and the cover 12, and may further include at least one of an area between the tuning screw 14 and an inside wall of the resonant tube 13, and an area between an outer edge area of the resonant tube 13 and a cavity wall of the resonant cavity 112. These areas have relatively high electric field strength.

The resonant tube 13 includes a resonant tube body 131 and an elastic structure 132 that is combined with the resonant tube body 131. The elastic structure 132 provides elastic pressure in an axial direction of the resonant tube 13 such that an upper end face of the medium material 17 is in close contact with a lower surface of the cover 12 and a lower end face of the medium material 17 is in close contact with an upper surface of the resonant tube 13. The elastic structure 132 may be disposed on the top of the resonant tube 13, in the middle of the resonant tube 13, or at the bottom of the resonant tube 13.

The medium material 17 includes but is not limited to ceramics, a single-crystal quartz, or alumina.

In an implementation manner, the medium material 17 is crimped between the cover 12 and the resonant tube 13. An implementation manner of the crimping may be as follows. A thickness of the medium material 17 is properly set, and when the cover 12 is securely installed on the resonant cavity body 11, the cover 12 presses the medium material 17, and the medium material 17 is closely crimped between the cover 12 and the resonant tube 13.

In an implementation manner, one surface of the medium material 17 is bonded with or welded to one of the cover 12 and the resonant tube 13, and another opposite surface is in close contact with the other one of the cover 12 and the resonant 13 using the elastic pressure provided by the elastic structure 132.

Further, a Qf of the medium material 17 is greater than 1000 in order to reduce a dielectric loss. In a common case, a Qf of 1000 is a boundary between a plastic medium material and a ceramic medium material. The Qf is a reciprocal of a dielectric loss of the medium material 17. Because a medium material 17 with a low loss can be padded in the resonator 100, in a case in which a volume of a resonant cavity 112 of the resonator 100 in this implementation manner is same as a volume of a resonant cavity 112 of a stepped impedance resonator (SIR), a loss of the medium material 17 may be even lower such that an increase in a dielectric loss brought by a padded medium material is less than a decrease in a conductor loss, and therefore, a loss of the resonator 100 provided in this embodiment of the present disclosure is smaller than that of an SIR technology.

Beneficial effects generated by the resonator 100 in this implementation manner of the present disclosure are as follows.

(1): A dielectric constant of the padded medium material 17 of the resonator 100 in this implementation manner of the present disclosure is greater than a dielectric constant of air. A larger dielectric constant of the medium material 17 leads to a larger equivalent capacitance, and a capacitance between the resonant tube 13 and the cover 12 is larger than that in an empty cavity such that the resonant cavity 112 can work at a lower frequency, or when a single cavity of a same resonant frequency is used, compared with a resonant cavity that is padded with air, the resonator 100 in this implementation manner has a smaller volume. Therefore, this embodiment of the present disclosure can reach an effect of reducing a volume of the resonator.

(2): In the resonator 100 in this implementation manner of the present disclosure, because the medium material 17 is padded in an area with relatively high electric field strength in the resonant cavity 112, a dielectric constant of the padded medium material 17 is greater than 1, and breakdown field strength of the medium material 17 is generally several to tens of times higher than breakdown field strength of air, compared with a resonant cavity that is padded with air, this implementation manner of the present disclosure can improve a power capacity of the resonator.

(3): In the resonator 100 in this implementation manner of the present disclosure, the elastic structure 132 is disposed on the resonant tube 13. The elastic structure 132 provides elastic pressure in an axial direction of the resonant tube 13 such that an upper end face of the medium material 17 is in close contact with a lower surface of the cover 12 and a lower end face of the medium material 17 is in close contact with an upper surface of the resonant tube 13, thereby ensuring that the medium material 17 is in close contact with both the cover 12 and the resonant tube 13. This effectively resolves a problem caused by a structure manufacturing error and an assembly tolerance such that various medium materials 17 can be in close contact with the cover 12 and the resonant tube 13, thereby improving adaptability and bringing effects of the foregoing (1) and (2) into full play.

(4): In the resonator 100 in this implementation manner of the present disclosure, a few medium materials 17 are padded in a part with relatively high electric field strength in the resonant cavity 112, and a volume of the padded medium materials is relatively small and costs are low. Manufacturing and installation costs of the elastic structure 132 of the resonant tube 13 are also relatively low, and in addition, advantages of low costs and reliable frequency adjustment of a traditional cavity resonator are also possessed.

Figure 2:
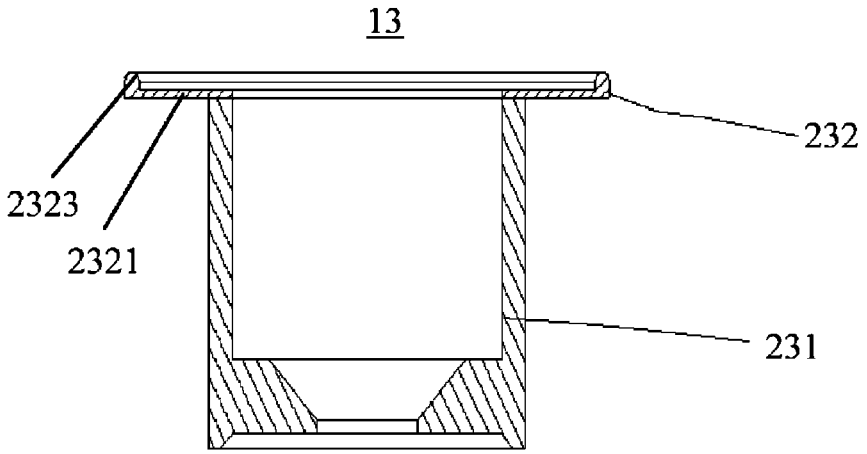
FIG. 2 is a cutaway diagram of a resonant tube according to a second implementation manner of the present disclosure.

Referring to FIG. 2, FIG. 2 is a structural diagram of a resonant tube 13 according to a second implementation manner of the present disclosure. The resonant tube 13 includes a resonant tube body 231 and an elastic structure 232 that is disposed on the top of the resonant tube body 231.

The elastic structure 232 is made up of an elastic material, for example, a metal plate. The elastic structure 232 includes a bottom plate 2321 and a surrounding wall 2323 that stretches out in a direction perpendicular to a periphery of the bottom plate 2321. The bottom plate 2321 is connected to the top of the resonant tube body 231 and extends outside of the resonant tube body 231. The top of the surrounding wall 2323 is pressed against a medium material. In this way, when the surrounding wall 2323 bears pressure in an axial direction, the bottom plate 2321 of the elastic structure 232 may be elastically deformed in the axial direction in order to provide elastic pressure that enables an upper end face of the medium material to be in close contact with a lower surface of a cover and a lower end face of the medium material to be in close contact with an upper surface of the resonant tube 13. By disposing the surrounding wall 2323, a deformation extent of the elastic structure 232 can be increased, thereby increasing the provided elastic pressure. The bottom plate 2321 may be integrated with the resonant tube body 231, or may be fastened by means of welding. In addition, further, as shown in FIG. 2, in this implementation manner, a rounding design may be performed on the top of the surrounding wall 2323, which, however, is not limited.

Figure 3:
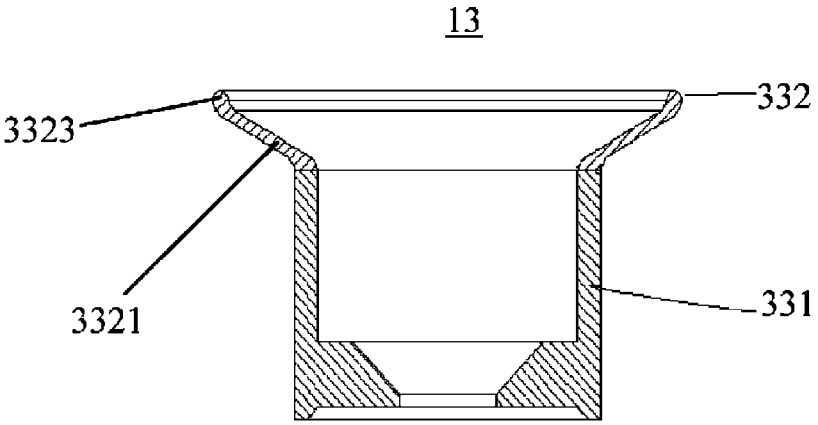
FIG. 3 is a cutaway diagram of a resonant tube according to a third implementation manner of the present disclosure.

Referring to FIG. 3, FIG. 3 is a structural diagram of a resonant tube 13 according to a third implementation manner of the present disclosure. The resonant tube 13 includes a resonant tube body 331 and an elastic structure 332 that is disposed on the top of the resonant tube body 331.

The elastic structure 332 is made up of an elastic material, for example, a metal plate. The elastic structure 332 includes a bowl-shaped part 3321 and a surrounding wall 3323 that stretches out in a direction perpendicular to a periphery of the top of the bowl-shaped part 3321. The bottom of the bowl-shaped part 3321 is connected to the resonant tube body 331. A diameter of the bowl-shaped part 3321 gradually increases in an axial direction away from the resonant tube body 331. The surrounding wall 3323 is pressed against a medium material. In this way, when the surrounding wall 3323 bears pressure in an axial direction, the bowl-shaped part 3321 of the elastic structure 332 may expand outward and be elastically deformed in order to provide elastic pressure that enables an upper end face of the medium material to be in close contact with a lower surface of the cover and a lower end face of the medium material to be in close contact with an upper surface of the resonant tube 13. By disposing the bowl-shaped part 3321, a deformation extent of the elastic structure 332 can be increased, thereby increasing the provided elastic pressure. The bowl-shaped part 3321 may be integrated with the resonant tube body 331, or may be fastened by means of welding. In addition, further, as shown in FIG. 2, in this implementation manner, a rounding design may be performed on the top of the bowl-shaped part 3321, which, however, is not limited.

Figure 4:
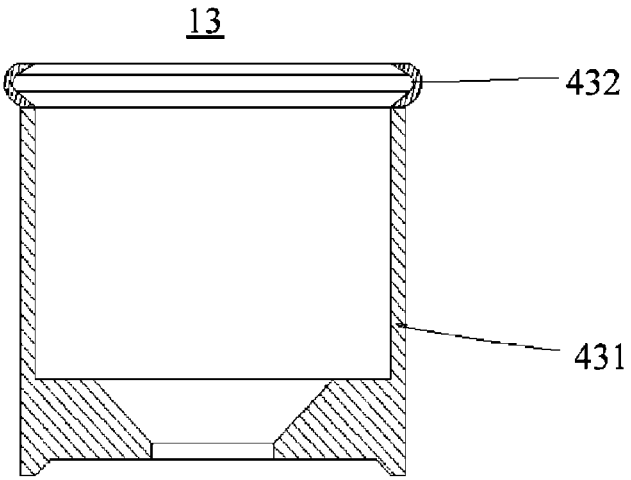
FIG. 4 is a cutaway diagram of a resonant tube according to a fourth implementation manner of the present disclosure.

Referring to FIG. 4, FIG. 4 is a structural diagram of a resonant tube 13 according to a fourth implementation manner of the present disclosure. The resonant tube 13 includes a resonant tube body 431 and an elastic structure 432 that is disposed on the top of the resonant tube body 431.

The elastic structure 432 is made up of an elastic material, for example, a metal plate. The elastic structure 432 forms a drum-shaped structure that protrudes in a radial direction of the resonant tube 13. A lower end face of the elastic structure 432 is connected to the top of the resonant tube body 431, and an upper end face of the elastic structure 432 is pressed against a medium material. In this way, when the elastic structure bears pressure in an axial direction, the elastic structure 432 provides, by means of elastic deformation of the drum-shaped structure of the elastic structure 432, elastic pressure that enables an upper end face of the medium material to be in close contact with a lower surface of the cover and a lower end face of the medium material to be in close contact with an upper surface of the resonant tube 13. In another implementation manner, the drum-shaped structure may also become concave in a radial direction of the resonant tube 13, and there may be one or more drum-shaped structures. The elastic structure 432 may be integrated with the resonant tube body 431, or may be fastened by means of welding.

Figure 5:
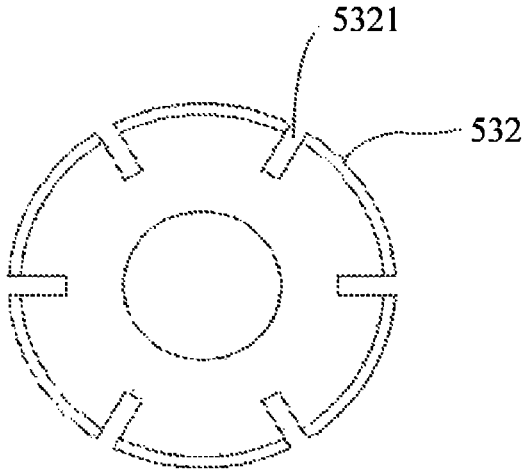
FIG. 5 is a cutaway diagram of a resonant tube according to a fifth implementation manner of the present disclosure.

Referring to FIG. 5, FIG. 5 is a structural diagram of a resonant tube according to a fifth implementation manner of the present disclosure. Several notches 5321 are disposed on an elastic structure 532 of the resonant tube in order to increase elasticity of the elastic structure 532. As shown in FIG. 5, several notches 5321 in a radial direction of the resonant tube may be disposed on a periphery of the elastic structure 532, and six notches 5321 are shown in the diagram. In this way, when the elastic structure 532 bears an axial force, spacing formed by these notches 5321 may increase space in which the elastic structure 532 is deformed, and increase elasticity. In addition, due to special current distribution in a resonator, this structure has no impact on electric performance.

Figure 6:
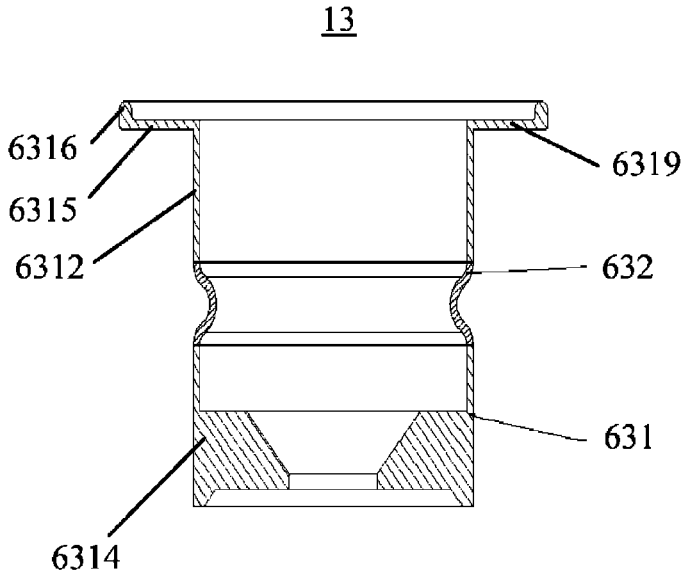
FIG. 6 is a cutaway diagram of a resonant tube according to a sixth implementation manner of the present disclosure.

Referring to FIG. 6, FIG. 6 is a structural diagram of a resonant tube 13 according to a sixth implementation manner of the present disclosure. The resonant tube 13 includes a resonant tube body 631 and an elastic structure 632 that is disposed in the middle of the resonant tube body 631.

The resonant tube body 631 includes a first body part 6312 and a second body part 6314 that are separately located at two sides of the elastic structure 632. The two sides of the elastic structure 632 are separately connected to the first body part 6312 and the second body part 6314. The elastic structure 632 is in a shape of a drum, and becomes concave (or convex) in a radial direction of the resonant tube 13. A pressing part 6319 is disposed on the top of the first body part 6312, where the pressing part 6319 is pressed against a medium material. The pressing part 6319 includes a bottom plate 6315 that extends outward and a surrounding wall 6316 that extends in a direction perpendicular to a periphery of the bottom plate 6315. When the pressing part 6319 bears pressure in an axial direction, the elastic structure 632 may be elastically deformed in order to provide elastic pressure that enables an upper end face of the medium material to be in close contact with a lower surface of the cover and a lower end face of the medium material to be in close contact with an upper surface of the resonant tube 13.

A shape of the elastic structure 632 is not limited to a drum shape, and the elastic structure 632 may also use a structure in any one of the second to the fifth implementation manners, for example, a bowl shape.

The elastic structures in the foregoing implementation manners may be made up of a metal plate, or certainly may use another elastic material, for example, an alloy material that can be elastically deformed.

A manner of connecting an elastic structure and a resonant tube body may be welding, or an elastic structure is integrated with a resonant tube.

A specific form of the elastic structure is not limited to manners provided in the foregoing specific implementation manners, a specific structure of the elastic structure can be designed provided that the structure can be elastically deformed in order to provide elastic pressure that enables an upper end face of a medium material to be in close contact with a lower surface of the cover and a lower end face of a medium material to be in close contact with an upper surface of a resonant tube.

Figure 7:
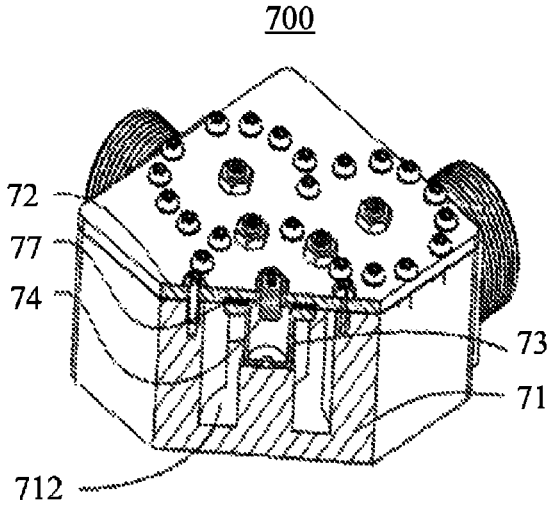
FIG. 7 is a schematic structural diagram of a filter according to a seventh implementation manner of the present disclosure.
Figure 8:
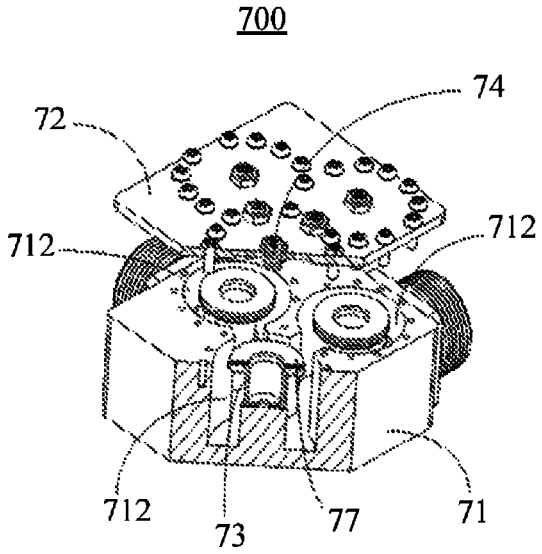
FIG. 8 is a three-dimensional exploded diagram of the filter according to the seventh implementation manner of the present disclosure.

Referring to FIG. 7 and FIG. 8, FIG. 7 and FIG. 8 are respectively a three-dimensional cutaway diagram and a three-dimensional exploded diagram of a filter 700 in an installation state according to a seventh implementation manner of the present disclosure. The filter 700 is formed by combing resonators, where at least one of the resonators uses a structure of the foregoing resonator. Generally, covers of resonators in the filter 700 are combined into a cover of the filter, and resonant cavities of N resonators are called N resonant cavities of the filter (N is an integer not less than 1). The filter 700 includes a box 71 and a cover 72 that covers the box 71. The box 71 is a metal box, and the cover 72 is a metal cover. The whole box 71 may be a metal material or the box 71 is a cavity body that is metallic at least on an inner surface. The whole metal cover 72 may be a metal material or the metal cover 72 is a plate that is metallic at least on a lower surface.

In this implementation manner, the filter 700 is a three-cavity filter. The box 71 has an open end and three resonant cavities 712. The cover 72 covers the open end. In each resonant cavity 712, a resonant tube 73 and a tuning screw 74 that is corresponding to the resonant cavity 712 are disposed. A medium material 77 is padded in an area with relatively high electric field strength in at least one resonant cavity 712.

At least one of the resonant tubes 73 uses any structure in the foregoing implementation manners.

It can be understood that, the medium material 77 whose dielectric constant is greater than 1 is padded in the area with relatively high electric field strength in the at least one resonant cavity of the filter provided in this embodiment of the present disclosure, and the medium material 77 is padded in a capacitor area formed in the resonant cavity 712. The capacitor area may include an area between the resonant tube 73 and the cover 72, and may further include at least one of an area between the tuning screw 74 and an inside wall of the resonant tube 73, and an area between an outer edge area of the resonant tube 73 and a cavity wall of the resonant cavity 712. These areas have relatively high electric field strength. In addition, a resonant tube in the foregoing at least one resonant cavity may use any structure in the foregoing implementation manners, for example, descriptions in embodiments corresponding to FIG. 1 to FIG. 6. For a structure of another part of the filter, reference may be made to a structure of a filter in the prior art, and details are not described herein and are not limited (that is, the structure may be used by combing structures of some future filters).

Figure 9:
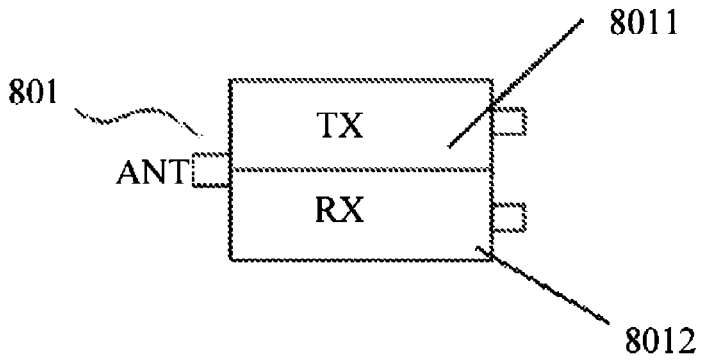
FIG. 9 is a schematic diagram of a duplexer according to an eighth implementation manner of the present disclosure.

Referring to FIG. 9, FIG. 9 is a schematic structural diagram of a duplexer 801 according to an eighth implementation manner of the present disclosure. The duplexer 801 includes a transmit channel filter 8011 and a receive channel filter 8012, where the transmit channel filter 8011 and the receive channel filter 8012 use the foregoing filter 700 to perform filtering. The transmit channel filter 8011 is configured to process a transmit signal of a transmitter, and the receive channel filter 8012 is configured to process a receive signal of a receiver.

Figure 10:
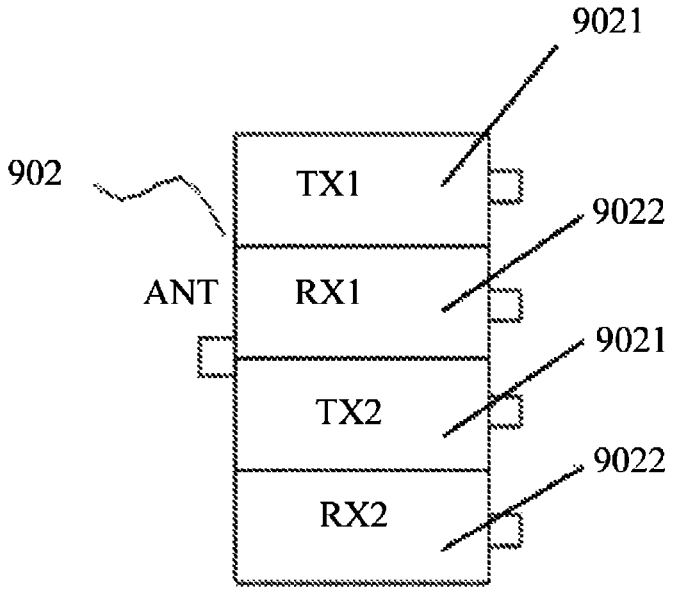
FIG. 10 is a schematic diagram of a multiplexer according to a ninth implementation manner of the present disclosure.

Referring to FIG. 10, FIG. 10 is a schematic structural diagram of a multiplexer 902 according to a ninth implementation manner of the present disclosure. The multiplexer 902 includes multiple transmit channel filters 9021 and multiple receive channel filters 9022, where the transmit channel filters 9021 and the receive channel filters 9022 use the foregoing filter 700 to perform filtering. Two transmit channel filters 9021 and two receive channel filters 9022 are shown in the diagram, and in another implementation manner, there may also be three or more transmit channel filters 9021 and receive channel filters 9022. The transmit channel filter 9021 is configured to process a transmit signal of a transmitter, and the receive channel filter 9022 is configured to process a receive signal of a receiver.

It may be understood that, the filter, the duplexer, or the multiplexer provided in the foregoing embodiments may be applied to a communications system, for example, a communications device (such as a base station or a terminal), or may be applied to a radar system, which may not be limited herein.

Finally, it should be noted that the foregoing embodiments are merely intended for describing the technical solutions of the present disclosure, but not for limiting the present disclosure. Although the present disclosure is described in detail with reference to the foregoing embodiments, a person of ordinary skill in the art should understand that the descriptions are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. A resonator, comprising:

a resonant cavity body;

a cover; and a resonant tube, wherein the resonant cavity body comprises a resonant cavity and an open end, wherein the cover is configured to cover the open end that is connected to the resonant cavity body, wherein the resonant tube is located inside the resonant cavity, wherein a medium material is padded in a capacitor area which comprises an area between the resonant tube and the cover in the resonant cavity, wherein the resonant tube comprises a resonant tube body and an elastic structure that is combined with the resonant tube body, wherein the elastic structure is used to provide elastic pressure in an axial direction of the resonant tube, and wherein the elastic structure is integrated with the resonant tube body.

2. The resonator according to claim 1, further comprising a tuning screw connected to the cover and is stuck into a space surrounded by the resonant tube.

3. The resonator according to claim 1, wherein the capacitor area further comprises: at least one of an area between a tuning screw and an inside wall of the resonant tube, and an area between an outer edge of the resonant tube and a cavity wall of the resonant cavity.

4. The resonator according to claim 1, wherein the elastic structure is fastened to the resonant tube body by means of welding.

5. The resonator according to claim 1, wherein the medium material comprises ceramics, a single-crystal quartz, or alumina.

6. The resonator according to claim 1, wherein the elastic structure is disposed on a top of the resonant tube, in a middle of the resonant tube, or at a bottom of the resonant tube.

7. The resonator according to claim 1, wherein the elastic structure comprises a bottom plate and a surrounding wall that stretches out in a direction perpendicular to a periphery of the bottom plate.

8. The resonator according to claim 1, wherein the elastic structure comprises a bowl-shaped part and a surrounding wall that stretches out in a direction perpendicular to a periphery of a top of the bowl-shaped part.

9. The resonator according to claim 1, wherein the elastic structure forms a drum-shaped structure that protrudes in a radial direction of the resonant tube body.

10. The resonator according to claim 1, wherein the resonant tube body comprises a first body part and a second body part that are separately located at two sides of the elastic structure.

11. The resonator according to claim 1, wherein a notch is disposed on the elastic structure to increase elasticity.

12. The resonator according to claim 1, wherein the elastic structure is a metal plate.

13. The resonator according to claim 1, wherein a quality factor (Qf) of the medium material is greater than 1000.

14. The resonator according to claim 1, wherein a dielectric constant of the medium material is greater than 1.

15. The resonator according to claim 1, wherein the padded medium material is separately crimped over the cover and the resonant tube.

16. The resonator according to claim 1, wherein one surface of the medium material is bonded with or welded to one of the cover and the resonant tube, and wherein another opposite surface is in close contact with the other one of the cover and the resonant tube using the elastic pressure provided by the elastic structure.

17. A resonator, comprising:

a resonant cavity body;

a cover; and a resonant tube, wherein the resonant cavity body comprises a resonant cavity and an open end, wherein the cover is configured to cover the open end that is connected to the resonant cavity body, wherein the resonant tube is located inside the resonant cavity, wherein a medium material is padded in a capacitor area which comprises an area between the resonant tube and the cover in the resonant cavity, wherein the resonant tube comprises a resonant tube body and an elastic structure that is combined with the resonant tube body, wherein the elastic structure is used to provide elastic pressure in an axial direction of the resonant tube, and wherein the padded medium material is separately crimped over the cover and the resonant tube.

18. A resonator, comprising:

a resonant cavity body;

a cover; and a resonant tube, wherein the resonant cavity body comprises a resonant cavity and an open end, wherein the cover is configured to cover the open end that is connected to the resonant cavity body, wherein the resonant tube is located inside the resonant cavity, wherein a medium material is padded in a capacitor area which comprises an area between the resonant tube and the cover in the resonant cavity, wherein the resonant tube comprises a resonant tube body and an elastic structure that is combined with the resonant tube body, wherein the elastic structure is used to provide elastic pressure in an axial direction of the resonant tube, and wherein the resonant tube body comprises a first body part and a second body part that are separately located at two sides of the elastic structure.

19. A resonator, comprising:

a resonant cavity body;

a cover; and a resonant tube, wherein the resonant cavity body comprises a resonant cavity and an open end, wherein the cover is configured to cover the open end that is connected to the resonant cavity body, wherein the resonant tube is located inside the resonant cavity, wherein a medium material is padded in a capacitor area which comprises an area between the resonant tube and the cover in the resonant cavity, wherein the resonant tube comprises a resonant tube body and an elastic structure that is combined with the resonant tube body, wherein the elastic structure is used to provide elastic pressure in an axial direction of the resonant tube, and wherein the elastic structure forms a drum-shaped structure that protrudes in a radial direction of the resonant tube body.

20. A resonator, comprising:

a resonant cavity body;

a cover; and a resonant tube, wherein the resonant cavity body comprises a resonant cavity and an open end, wherein the cover is configured to cover the open end that is connected to the resonant cavity body, wherein the resonant tube is located inside the resonant cavity, wherein a medium material is padded in a capacitor area which comprises an area between the resonant tube and the cover in the resonant cavity, wherein the resonant tube comprises a resonant tube body and an elastic structure that is combined with the resonant tube body, wherein the elastic structure is used to provide elastic pressure in an axial direction of the resonant tube, and wherein the elastic structure comprises a bowl-shaped part and a surrounding wall that stretches out in a direction perpendicular to a periphery of a top of the bowl-shaped part.

21. A resonator, comprising:

a resonant cavity body;

a cover; and a resonant tube, wherein the resonant cavity body comprises a resonant cavity and an open end, wherein the cover is configured to cover the open end that is connected to the resonant cavity body, wherein the resonant tube is located inside the resonant cavity, wherein a medium material is padded in a capacitor area which comprises an area between the resonant tube and the cover in the resonant cavity, wherein the resonant tube comprises a resonant tube body and an elastic structure that is combined with the resonant tube body, wherein the elastic structure is used to provide elastic pressure in an axial direction of the resonant tube, and wherein the elastic structure is fastened to the resonant tube body by means of welding.

22. A resonator, comprising:

a resonant cavity body;

a cover; and a resonant tube, wherein the resonant cavity body comprises a resonant cavity and an open end, wherein the cover is configured to cover the open end that is connected to the resonant cavity body, wherein the resonant tube is located inside the resonant cavity, wherein a medium material is padded in a capacitor area which comprises an area between the resonant tube and the cover in the resonant cavity, wherein the resonant tube comprises a resonant tube body and an elastic structure that is combined with the resonant tube body, wherein the elastic structure is used to provide elastic pressure in an axial direction of the resonant tube, and wherein the elastic structure comprises a bottom plate and a surrounding wall that stretches out in a direction perpendicular to a periphery of the bottom plate.

* * * * *